United States Patent [19]

Nelson et al.

[11] Patent Number: 4,498,813

[45] Date of Patent: Feb. 12, 1985

[54] UNDERGROUND CABLE INSTALLING APPARATUS AND METHOD UTILIZING A FLUID JET ASSISTED, VIBRATING BLADE ARRANGEMENT

[75] Inventors: Terry L. Nelson, Camas Valley, Oreg.; James M. Reichman, Issaquah, Wash.

[73] Assignee: Electric Power Research Institute, Inc., Palo Alto, Calif.

[21] Appl. No.: 269,968

[22] Filed: Jun. 3, 1981

[51] Int. Cl.[3] ..... E02F 5/10; F16L 1/02

[52] U.S. Cl. ..... 405/182; 405/180

[58] Field of Search ..... 405/163, 174, 175, 180, 405/182, 183; 37/98, 193, DIG. 18; 172/40

[56] References Cited

U.S. PATENT DOCUMENTS 3,287,922 11/1966 Harmstorf ..... 405/182

3,338,060 8/1967 Harmstorf ..... 405/163

3,688,511 9/1972 Harmstorf ..... 405/163 X

*Primary Examiner*—David H. Corbin

*Attorney, Agent, or Firm*—Flehr, Hohbach, Test, Albritton & Herbert

[57] ABSTRACT

An underground cable installing apparatus is disclosed herein along with its method of operation. The apparatus utilizes a power driven land vehicle and an elongated cable laying plow handle supported by and for movement with the vehicle in a way which places a lowermost end portion of the blade in the ground with its cutting edge disposed in the direction of movement of the vehicle. In accordance with one operational feature of the apparatus disclosed herein, a plurality of high impact fluid jets are used to aid the cable laying plow blade in cutting through the earth. In accordance with another feature, the blade is also subjected to vibration, preferably by placing a vibratory member on the in-ground portion of the blade.

11 Claims, 4 Drawing Figures

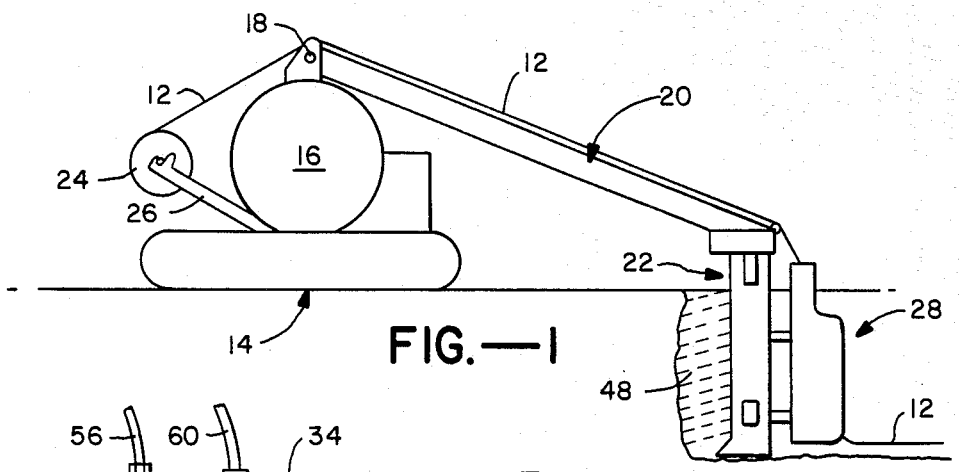
FIG.—1
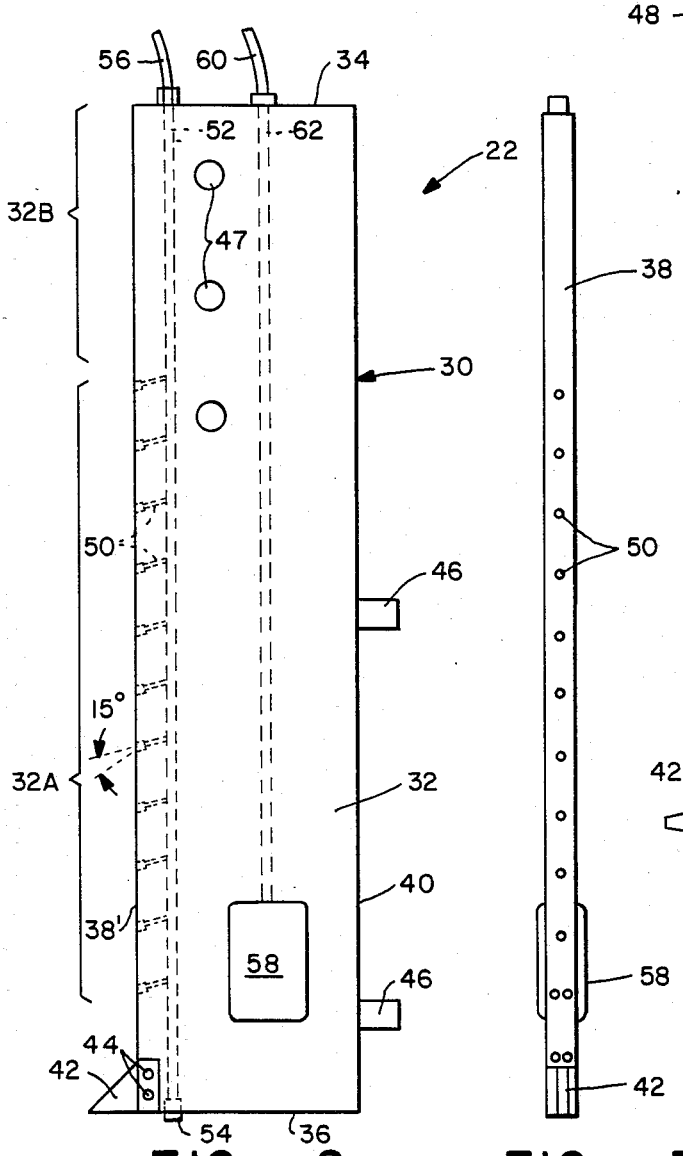
FIG.—2
FIG.—3
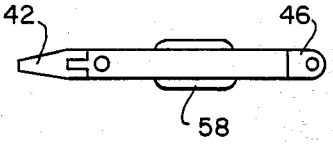
FIG.—4

UNDERGROUND CABLE INSTALLING APPARATUS AND METHOD UTILIZING A FLUID JET ASSISTED, VIBRATING BLADE ARRANGEMENT

The present invention relates generally to apparatus for installing cable underground and more particularly to a specifically designed cable laying plow blade arrangement for use in such apparatus.

One present method of installing electrical cable underground is to utilize a power driven land vehicle in combination with an elongated cable laying plow blade and a cable feed mechanism. The plow blade is supported by and for movement with the vehicle in a way which places a lowermost end portion of the blade in the ground with its cutting edge disposed in the direction of movement of the vehicle. At the same time, the feed mechanism continuously feeds a supply of cable to an in-ground point on the blade and from there directly into the ground along the path taken by the blade as it moves with the vehicle. An example of an apparatus of this type may be found in co-pending United States patent application Ser. No. 269,955, now U.S. Pat. No. 4,430,022, entitled UNDERGROUND CABLE INSTALLING APPARATUS AND METHOD UTILIZING A MULTI-POSITIONABLE PLOW BLADE and filed on the same date and by the same assignee as the present application.

While the underground cable installing apparatus described generally above and specifically the one disclosed in the co-pending application just recited is generally satisfactory for its intended purpose, it is a primary object of the present invention to improve the cutting or plowing capabilities of its cable laying plow blade in an uncomplicated and economical way.

A more particular object of the present invention is to provide a cable laying plow blade which is assisted in its underground cutting or plowing operation by means of high impact fluid jets which are incorporated into the cutting edge of the blade in a relatively uncomplicated and yet reliable manner.

Another particular object of the present invention is to provide a cable laying plow blade which is assisted in its underground cutting or plowing operation by means of vibration, without adversely affecting the rest of the apparatus and without requiring a high powered vibratory member.

As will be described in more detail hereinafter, the underground cable installing apparatus disclosed herein is one which utilizes a power driven land vehicle and an elongated cable laying plow blade having a top end portion, a bottom end portion, and a forward facing cutting edge forming the front edge of the blade's bottom end portion. The blade is supported by and for movement with the vehicle in a way which places its bottom end portion in the ground with the cutting edge disposed in its direction of movement. In accordance with one aspect of the present invention, the overall apparatus utilizes means including a plurality of nozzles positioned along the cutting edge of the blade for receiving fluid under pressure and directing this fluid through the nozzles to form high impact fluid jets which aid in cutting through the earth. In accordance with another feature of the present invention, the overall apparatus includes a vibratory device and specifically one located on the in-ground portion of the blade for vibrating the latter and thereby assisting in its cutting or plowing capabilities. Moreover, by placing the vibratory device in the ground with the blade portion to be vibrated, that portion is subjected to maximum vibration while the rest of the overall apparatus is at most subjected to a minimal amount of vibration.

The overall underground cable installing apparatus and particularly its fluid jet assisted, vibrating blade arrangement will be discussed in more detail hereinafter in conjunction with the drawings wherein:

FIG. 1 is a side elevational view of the overall apparatus including its cable laying plow blade arrangement designed in accordance with the present invention;

FIG. 2 is an enlarged side elevational view of the plow blade shown in FIG. 1;

FIG. 3 is a front elevational view of the blade arrangement illustrated in FIG. 2; and FIG. 4 is an upwardly directed plan view illustrating the bottom of the blade arrangement illustrated in FIG. 2.

Turning now to the drawings, attention is first directed to FIG. 1 which illustrates an overall apparatus 10 for installing cable 12 or like tubular material underground. The apparatus includes a power driven land vehicle 14 such as the tractor illustrated, which vehicle includes a main housing unit 16 for containing the appropriate controls as well as other components necessary to the operation of the overall apparatus. Main unit 16 carries on its top side a tower 18 which, in turn, supports one end of a boom arrangement 20. The other end of the boom arrangement supports a cable laying plow blade arrangement 22 which is designed in accordance with the present invention, as will be discussed hereinafter.

Main unit 16, tower 18, and boom arrangement 20 together support plow blade arrangement 22 for movement with vehicle 14 and also relative to vehicle 14 between at least two positions, an in-ground cable laying first position as shown in FIG. 1 and an inoperative second position immediately above the ground. In a preferred embodiment, main unit 16, tower 18 and boom arrangement 20 are designed to maneuver the plow blade arrangement between a much greater number of positions than the two mentioned, as described in the previously recited co-pending U.S. patent application.

In addition to the various components and arrangements discussed thus far, overall apparatus 10 includes a cable reel or drum 24 or like means for containing a supply of cable 12 and suitable means generally indicated at 26 for supporting the cable drum on and for movement with vehicle 14. A feed mechanism or shoe generally indicating at 28 cooperates with the cable supply for feeding cable from the latter to an in-ground point on blade arrangement 22 and from this point into the ground along the path taken by the vehicle and blade arrangement. In the particular embodiment illustrated, cable 12 is slidably supported from reel 24 across main unit 16 and along boom arrangement 20 by suitable means (not shown) and into feed mechanism 28 which is attached to blade arrangement 22. The feed mechanism does not per se form part of the present invention and hence will not be described in detail herein. It should suffice to say that this mechanism moves with the blade arrangement through the ground and as it does so it lays cable 12 down behind it.

Turning to FIGS. 2–4, attention is specifically directed to blade arrangement 22 which, as stated previously, is designed in accordance with the present invention. As seen best in FIG. 2, this arrangement includes a cable laying plow blade 30 which has an elongated, rectangular body 32 of metal or other suitable material defined by top and bottom ends 34 and 36, respectively, a forwardly facing front edge 38 (see FIG. 3) and a rearwardly facing back edge 40. From a functional standpoint, plow blade 30 may be divided into two portions, a bottom portion 32A which is disposed within the ground when overall blade arrangement 22 is in its cable laying first position and a top portion 32B which is disposed above ground during the cable laying operation of the overall blade arrangement. Thus, the front edge segment of bottom portion 32 which is generally indicated at 38' serves as a forward facing cutting edge. In order to help stabilize main body 32 as the latter moves through the ground, a forwardly protruding, pointed tooth 42 is mounted to the bottom front edge of body 32 by suitable means such as bolts 44. The back edge 40 of blade 30 includes two mounting plates 46 which are fixedly mounted thereto and which serve to support feed mechanism 28 in the position illustrated in FIG. 1. Also, a number of through holes 47 are provided through blade body for mounting the blade to boom arrangement 20.

In accordance with one aspect of the present invention, blade arrangement 22 not only includes blade 30 as described thus far but also means forming a number of high impact fluid jets 48 (see FIG. 1) which are directed in the forward direction from front edge 38, primarily (if not exclusively) along cutting edge 38'. In the specific embodiment illustrated, this is accomplished by means of a plurality of nozzles 50 extending into blade body 32 from front edge 38 and a continuous manifold 52 extending lengthwise entirely through the blade body from its top end 34 to its bottom end 36. Manifold 52 is in fluid communication with all of the nozzles 50, as illustrated in FIG. 2, and is closed at its bottom end by a suitable means such as set screw 54. Its top end is seal connected in fluid communication with an incoming conduit 56 which serves to direct fluid under pressure, specifically water in a preferred embodiment, into manifold 52 from a suitable supply (not shown) carried on vehicle 14. While not shown in FIG. 1, conduit 56 does extend from the top edge of blade 34 to its supply of fluid on the vehicle, for example through boom arrangement 20. As the water or other such fluid under pressure fills manifold 52 it passes out of nozzles 50 so as to form the previously recited relatively high impact jets 48. These jets aid the cutting edge 38' causing the overall blade to move through the earth as it is pulled or pushed by vehicle 14.

In an actual working embodiment, plow blade 32 is 50 inches long (from top edge 34 to bottom edge 36), it is 11 inches wide (from front edge 38 to back edge 40) and it is $1\frac{1}{2}$ inches thick. The tooth 42 projects out from front edge 38 a maximum distance of $2\frac{1}{2}$ inches. In this particular embodiment fourteen nozzles 50 are utilized, ten being disposed in longitudinally spaced relationship to one another, most along an upper segment of cutting edge 38' and four are clustered along a bottom segment in both longitudinal and lateral relationship to one another, as best seen in FIG. 3. Each of the nozzles is oriented in a downwardly and forward direction at an angle of approximately 15° to a line perpendicular to edge 38 as best seen in FIG. 2. This downward angle (or an upward angle) causes the jets to slice through the soil, i.e., forming a kerf. This should be contrasted with jets which are oriented parallel to the direction of movement of the blade. Each of these latter jets tends to punch out a single hole in the confronting soil rather than slicing out a kerf. By clustering a large number of nozzles near the bottom front end of the blade, some stress is relieved at this point.

It is to be understood that the specific embodiment of plow blade 30 just recited and the specifically described assembly of nozzles are not intended to limit the present invention The plow blade itself may vary in size and shape and the assembly of nozzles and its manifold may vary also.

In accordance with a second aspect of the present invention, overall blade arrangement 22 includes a vibratory member 58 which is disposed on and carried by the in-ground portion 32A of blade body 32 for vibrating the latter and thereby aid the overall blade arrangement in its movement through the ground. The in-ground position of vibratory member 58 is to be contrasted with above ground installations. In this latter approach, the vibratory member is disposed at the top end of the blade and must be sufficiently powerful to cause the in-ground end portion of the blade to vibrate, taking into account the dampening effects caused by the length of the blade and the surrounding soil. However, if the vibrator is sufficiently large to vibrate the in-ground portion of the blade effectively under these circumstances, it is often too powerful for the immediate above-ground components surrounding it. More specifically, by placing a powerful vibrating member at the top, externally located end of the plow blade, the components immediately surrounding the vibrating member such as boom arrangement 20 are subjected to the same vibrations but without any dampening and hence could become damaged thereby. By placing the vibratory member in the ground with and at the in-ground portion of the plow blade, the appropriate component, that is, the in-ground portion of the blade receives maximum vibration without dampening. At the same time, those components which are not to be vibrated such as boom arrangement 20 are subjected to at most a minimum amount of vibration since the above-ground portion of the blade and the surrounding soil serve as dampers for this vibration.

Vibratory member 58 may be of any suitable type which is compatible with the rest of blade arrangement 22 and overall apparatus 10 and which is capable of subjecting the in-ground portion of blade 30 to the desired vibration. In this latter regard, it is to be understood that the magnitude and frequency of vibration will depend upon the overall design of the blade 30 and can be readily provided based on this design. Moreover, the vibratory member itself can be of any suitable type to accomplish its intended end and can be appropriately powered electrically, pneumatically or hydraulically. In any event, suitable power supplying means generally indicated by the conduit 60 is illustrated in FIG. 2. In the embodiment illustrated, this conduit extends from member 58 through a cooperating passageway 62 in blade body 32 and out the top end 34 of the blade body. In the case of hydraulic or pneumatic actuation, the passageway itself may form part of the conduit. While not shown in FIG. 1, conduit 60 extends from blade 30 to the appropriate power supply for member 58, which power supply is located on and carried by vehicle 14.

In the actual working embodiment of overall blade arrangement 22 recited above, vibratory member 58 is a hydraulically powered member capable of vibrating the in-ground portion of blade 30 with a frequency of 6,000 rpm and a magnitude of 4,000 lbs. force. The 6,000 rpm level was selected because the natural frequency of the blade is slightly below this frequency. Thus, when the blade moves loosely through the soil, the vibrator causes it to vibrate at a relatively low frequency (well below its natural frequency). However, when the blade tightens up within the soil, for example as it moves into rock or hard soil, the frequency of the vibrator rises, eventually causing the blade to reach its natural frequency, and thereby hopefully break loose within the rock or hard soil. Therefore, it is important to provide a vibrator having a maximum frequency at least equal to and preferably slightly greater than the natural frequency of the blade so that the latter can be subjected to sufficient vibration to reach its natural frequency. It is to be understood however that the present invention is not limited to this particular vibrating member although a member which is sufficiently powerful to vibrate its blade at the natural frequency of the latter is preferred.

What is claimed is:

1. An apparatus for installing cable underground, comprising: a power driven land vehicle; an elongated cable laying plow blade having a top end portion, a bottom end portion, and a forward facing cutting edge extending along the front edge of said bottom end portion; means including a plurality of nozzles positioned along said cutting edge for receiving fluid under pressure and directing said fluid through said nozzles to form high impact fluid jets; means supporting said blade for movement with said vehicle in a way which places the bottom end portion of said blade in the ground with its cutting edge and said fluid jets disposed in the direction of movement of said vehicle; means including a supply of said cable supported on and movable with said vehicle; means for vibrating said blade at the natural frequency of said blade and means for feeding said cable from its supply downwardly along a path to the rear of said blade to a point to the rear of the bottom end portion of said blade and along the path taken by said blade.

2. An apparatus according to claim 1 wherein said nozzles are disposed in spaced relationship to one another along the length of said cutting edge and define spray axes oriented at fixed non-perpendicular angles with said cutting edge.

3. An apparatus according to claim 2 wherein said cutting edge is substantially straight and wherein all of said axes are oriented downwardly at an angle of about 15° with a perpendicular line through said cutting edge.

4. An apparatus according to claim 1 wherein said nozzles include a first group disposed in longitudinally spaced relationship to one another along the length of a top segment of said cutting edge and a second group clustered in lateral and longitudinal relationship with one another along a bottom segment of said cutting edge.

5. An apparatus according to claim 1 wherein said blade includes a main body and wherein said nozzles include means for forming high impact jets includes a manifold through said main body and in fluid communication with said nozzles for receiving said fluid and directing the latter to said nozzles.

6. An apparatus according to claim 1 wherein said vibrating means is disposed on the bottom end portion of said blade whereby to move in the ground with said bottom end portion.

7. An apparatus for installing cable underground comprising: a power driven land vehicle, an elongated cable laying plow blade having a top end portion, a bottom end portion, and a forward facing cutting edge extending along the front edge of said bottom end portion; means including a vibratory element connected with and located on the bottom end portion of said blade for vibrating said bottom end portion at the natural frequency of said blade; means supporting said blade for movement with said vehicle in a way which places the bottom end portion of said blade with its cutting edge and said vibratory element in the ground; means including a supply of said cable supported on and movable with said vehicle; and means for feeding said cable from its supply downwardly along a path to the rear of said blade to a point to the rear of the bottom end portion of said blade and along the path taken by said blade.

8. An apparatus according to claim 7 wherein said vibrating means is sufficiently powerful to vibrate said blade at the natural frequency of the latter when said blade is held tightly in the ground.

9. An apparatus for installing cable underground, comprising a power driven land vehicle, an elongated cable laying plow blade having a top end portion, a bottom end portion, and a forward facing substantially straight cutting edge extending along the front edge of said bottom end portion; means including a manifold through said blade and a plurality of nozzles positioned along said cutting edge for receiving fluid under pressure and directing said fluid through said nozzles to form high impact fluid jets oriented at an angle of about 15° with a line perpendicular to said cutting edge, a first group of said nozzles being disposed in longitudinal relationship to one another along said segment of said cutting edge and a second group being clustered in both lateral and longitudinal relationship to one another on a lower segment of said cutting edge, means including a vibratory member mounted to said blade on its bottom end portion for vibrating the latter at the natural frequency of the blade; means supporting said blade for movement with said vehcile in a way which places said vibratory member and the bottom end portion of said blade in the ground with said cutting edge and fluid jets disposed in the direction of movement of said vehicle; means including a supply of said cable supported on and movable with said vehicle; and means for feeding said cable from its supply downwardly along a path to the rear of said blade to a point to the rear of the bottom end portion of said blade and along the path taken by said blade.

10. A cable laying plow blade arrangement for use in an underground cable installing apparatus in which a moving land vehicle carries a cable laying plow blade with it such that a bottom end portion of the latter moves through the ground along the same path as said vehicle while, at the same time, cable is fed from a supply downwardly along a path to the rear of said blade to a point on the bottom end portion of said blade and along said path, said blade arrangement comprising a blade having a top end portion, a bottom end portion, and a forward facing cutting edge extending along the front edge of said bottom end portion; means including a plurality of nozzles positioned along said cutting edge for receiving fluid under pressure and directing said fluid through said nozzles to form high impact fluid jets; and means including a vibratory member mounted on the bottom end portion of said blade for vibrating the latter at the natural frequency of said blade.

11. A method of installing cable underground comprising the steps of: providing a power driven land vehicle carrying a cable laying plow blade arrangement including a blade having a top end portion, a bottom end portion, and a forward facing cutting edge extending along the front edge of said bottom end portion and means incuding a plurality of nozzles positioned along said cutting edge for receiving fluid under pressure and directing said fluid through said nozzles to form high impact fluid jets; supporting said blade for movement with said vehicle in a way which places the bottom end portion of said blade in the ground with its cutting edge disposed in the direction of movement of said vehicle; moving said vehicle to move said cutting edge through the ground; and, at the same time, producing said jets, applying vibration to said blade at the natural frequency of said blade at a point on said bottom end portion, and feeding cable from a supply downwardly along a path to the rear of said blade to a point on the bottom end portion of said blade and along the path taken by said blade.

* * * * *